US008677979B2

(12) United States Patent
Ryu et al.

(10) Patent No.: US 8,677,979 B2
(45) Date of Patent: Mar. 25, 2014

(54) METHOD FOR CONTROLLING EVAPORATION GAS TREATING APPARATUS IN VEHICLE

(75) Inventors: Buyeol Ryu, Hwaseong-si (KR); Myeonghwan Kim, Hwaseong-si (KR); Dongmyoung Ryoo, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 283 days.

(21) Appl. No.: 13/194,638

(22) Filed: Jul. 29, 2011

(65) Prior Publication Data

US 2012/0138022 A1 Jun. 7, 2012

(30) Foreign Application Priority Data

Dec. 1, 2010 (KR) ..... 10-2010-0121513

(51) Int. Cl.
*F02M 33/06* (2006.01)

(52) U.S. Cl.
USPC ..... 123/520; 123/557

(58) Field of Classification Search
USPC ..... 123/518–520, 557
See application file for complete search history.

(56) References Cited

U.S. PATENT DOCUMENTS

| | | | | |
|---|---|---|---|---|
| 6,689,196 | B2 * | 2/2004 | Amano et al. | 96/112 |
| 6,695,895 | B2 * | 2/2004 | Hyodo et al. | 96/111 |
| 6,823,851 | B2 | 11/2004 | Amano et al. | |
| 2009/0084363 | A1 * | 4/2009 | Reddy | 123/520 |
| 2010/0094493 | A1 * | 4/2010 | Atsumi | 701/22 |
| 2010/0252006 | A1 * | 10/2010 | Reddy | 123/519 |

FOREIGN PATENT DOCUMENTS

| | | | |
|---|---|---|---|
| JP | 11-343890 | A | 12/1999 |
| JP | 2003-227420 | A | 8/2003 |
| JP | 2008-38708 | A | 2/2008 |
| JP | 2009-83541 | A | 4/2009 |
| JP | 2009-121357 | A | 6/2009 |
| KR | 10-2004-0094039 | A | 11/2004 |
| KR | 10-2005-0066155 | A | 6/2005 |
| KR | 10-2009-0109128 | A | 10/2009 |

* cited by examiner

*Primary Examiner* — Hai Huynh
(74) *Attorney, Agent, or Firm* — Morgan, Lewis & Bockius LLP

(57) ABSTRACT

Provided is a method for controlling evaporation gas treating apparatus that can effectively prevent evaporation gases from leaking out of a vehicle with minimizing power consumption of a battery in the vehicle and improving efficiency of purging the evaporation gases, by selectively operating a heater for when a large amount of evaporation gases are contained in active carbon of a canister.

6 Claims, 2 Drawing Sheets

METHOD FOR CONTROLLING EVAPORATION GAS TREATING APPARATUS IN VEHICLE

CROSS-REFERENCE TO RELATED APPLICATIONS

The present application claims priority to Korean Patent Application Number 10-2010-0121513 filed Dec. 1, 2010, the entire contents of which application is incorporated herein for all purposes by this reference.

BACKGROUND OF INVENTION

1. Field of Invention

The present invention relates to a method for controlling evaporation gas treating apparatus in a vehicle, and more particularly, to a technology for achieving more efficient purging of an evaporation gas in consideration of whether a large amount of evaporation gas is collected in active carbon of a canister.

2. Description of Related Art

The environment is polluted by evaporation gases that are produced by evaporation of the fuel in the fuel tanks of vehicles and discharged to the atmosphere, such that the fuel evaporation gases produced from the fuel tanks should be appropriated treated not to be discharged to the outside.

The evaporation gases produced from the fuel tanks in common vehicles are collected in the canister and then purged to the intake system of the engine by a purge control solenoid valve (PCSV) to be burned in the engines while the engine operates, in the related art.

Recently, since hybrid vehicles or plug-in hybrid vehicles are usually driven by motors, with the engine stopped, excessive fuel evaporation gases are produced from the fuel tank when the engine does not operates for a long time or temperature is high and exceed the collecting capacity of the canister, such that the evaporation gases are likely to be discharged to the atmosphere.

Therefore, a heating canister has been developed to purge the evaporation gases collected in the canister to the engine in a large amount within a short time with the engine in operation.

The heating canister is equipped with a heater, such that as heat is supplied when the evaporation gases collected in the canister is purged to the engine, the evaporation gases in the active carbon of the canister is more easily separated from the active carbon and supplied to the engine, by the heat from the heater.

However, operating the heater of the canister for each purging of the evaporation gases more discharges the battery by the power consumed by the heater, which reduces the available traveling distance of the hybrid vehicles and has an adverse effect on the commercial quality and fuel efficiency.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a method for controlling evaporation gas treating apparatus that can effectively prevent evaporation gases from leaking out of a vehicle with minimizing power consumption of a battery in the vehicle and improving efficiency of purging the evaporation gases, by selectively operating a heater for when a large amount of evaporation gases are collected in active carbon of a canister.

Various aspects of the present invention provide for a method for controlling evaporation gas treating apparatus in a vehicle, including determining operating a heater that determines whether to operate a heater of a canister due to a large amount of absorption of the canister, and operating a heater that operates the heater such that evaporation gases in the canister can be sufficiently separated, when it is required to operate the heater after the determining operating a heater.

According to various aspects of the present invention, it is possible to effectively prevent evaporation gases from leaking out of a vehicle with minimizing power consumption of a battery in the vehicle and improving efficiency of purging the evaporation gases, by selectively operating a heater for when a large amount of evaporation gases are contained in active carbon of a canister.

Further, it is possible to quickly purge an evaporation gas with the start of an engine by preheating the heater in advance, when the engine does not operate for a long period of time and it is required to operate the engine to protect the engine and prevent the lubricant from deteriorating.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
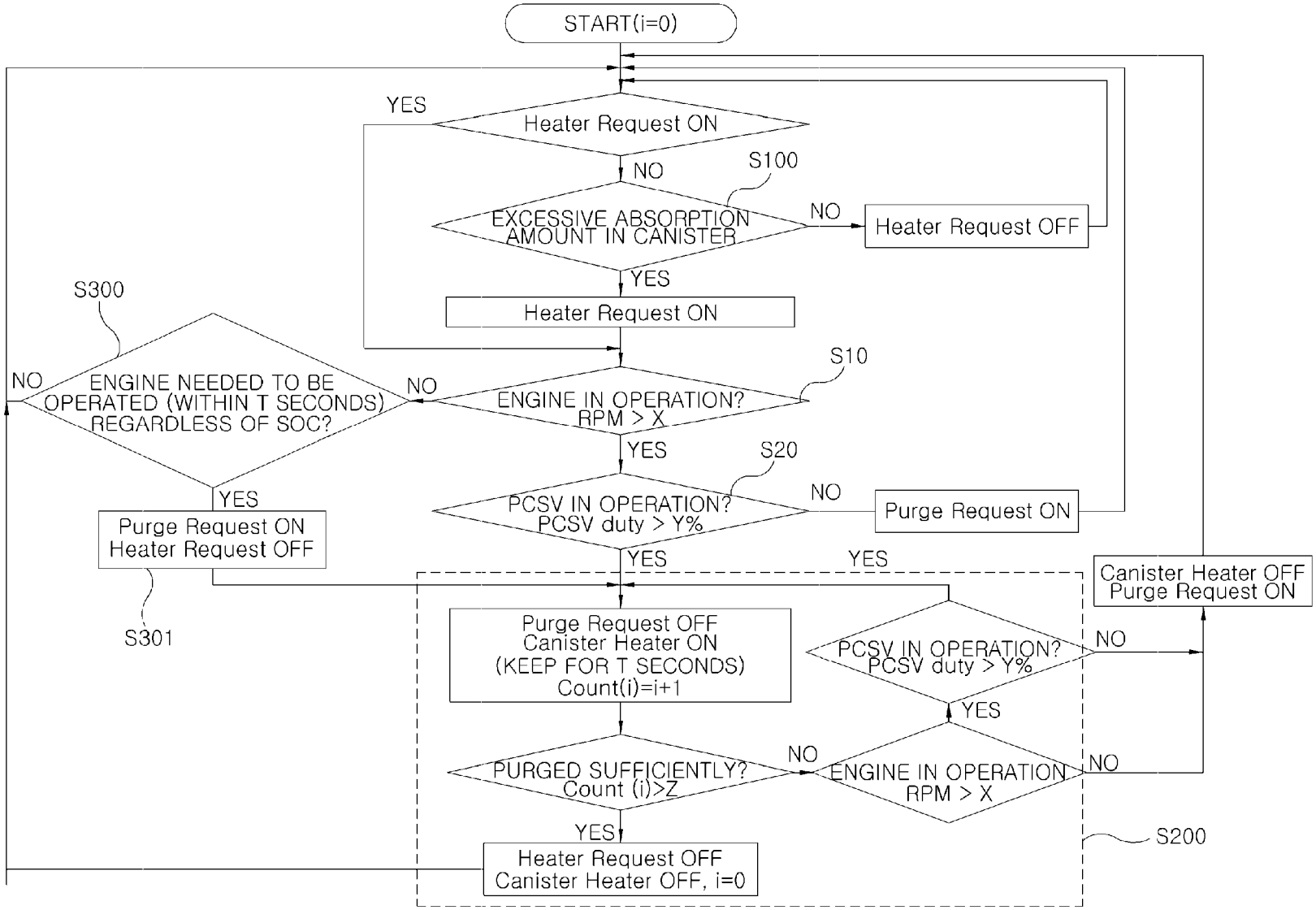
FIG. 1 is a flowchart illustrating an exemplary method for controlling evaporation gas treating apparatus in a vehicle according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Referring to FIG. 1, the present invention includes determining operating a heater (S100) that determines whether to operate a heater of a canister due to a large amount of absorption of the canister and operating a heater (S200) that operates the heater such that evaporation gases in the canister can be sufficiently separated, when it is required to operate the heater after the determining operating a heater (S100).

Figure 2:
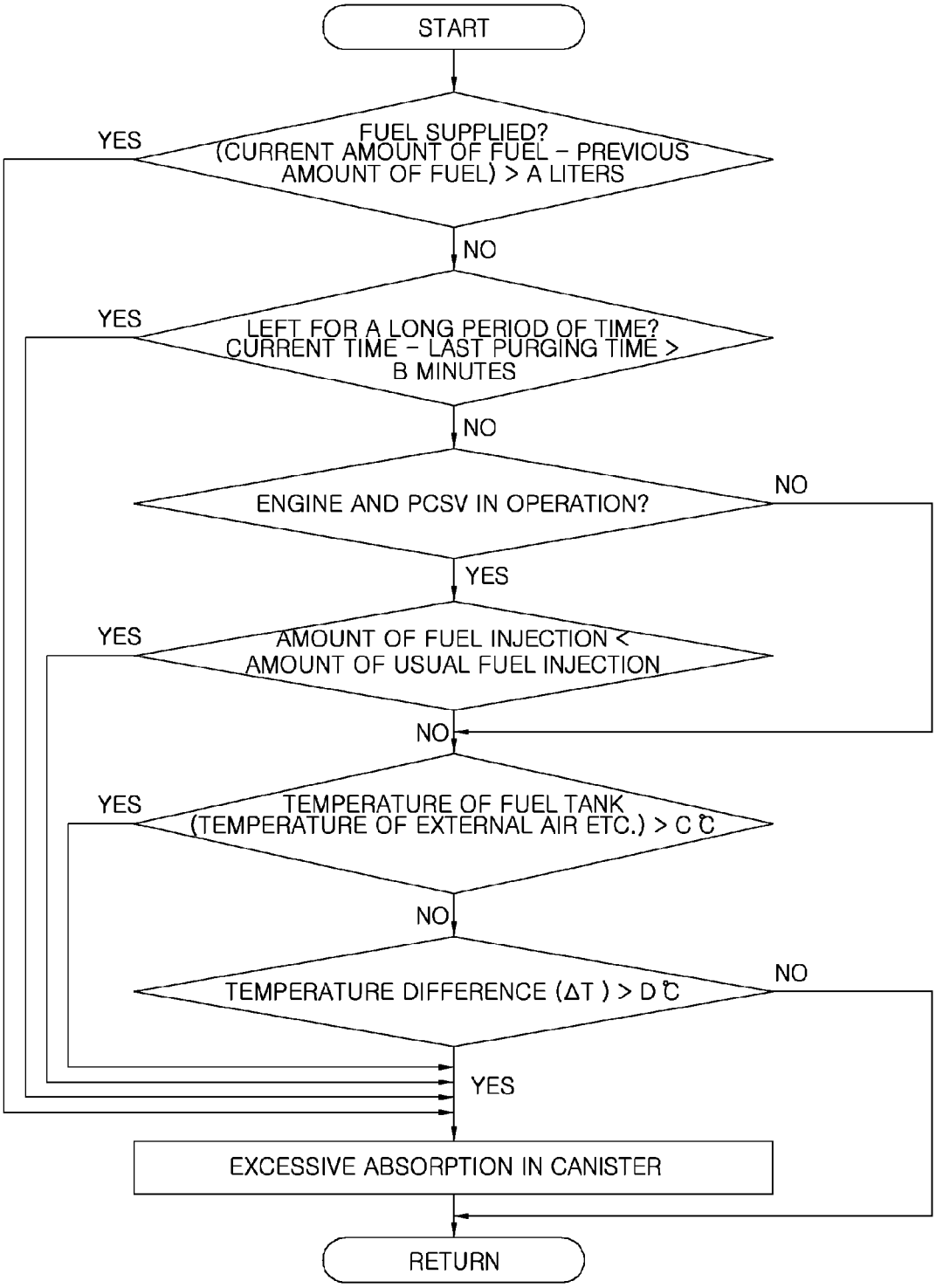
FIG. 2 is a flowchart showing performing an exemplary determining operation of heater shown of FIG. 1.

The determining operating a heater (S100), as shown in FIG. 2, determines that the heater needs to be operated, in at least one case of when fuel has been supplied, when the vehicle is left for a long time, when a dense evaporation gas flows into the engine, with a PCSV in operation, when the temperature of the fuel tank is above a predetermined temperature, and when a difference in temperature is large.

That is, since a large amount of evaporation gas is generally produced from the fuel tank while the fuel is supplied, this is determined as when the heater of the canister needs to be operated. Accordingly, when the fuel has been supplied and the difference between the current amount of fuel and the previous amount of fuel is above A liters, a predetermined amount, it is determined that fuel has been supplied.

Further, a large amount evaporation gas that has been produced from the fuel tank is collected in the canister when the vehicle is left for a long time, such that it is recognized that it needs to operate the heater of the canister.

When the vehicle is left for a long period of time and the difference between the current time and the time of the last purging is above B minutes, a predetermined time, it is determined that the vehicle has been left for a long period of time.

When a dense evaporation gas flows into the engine, with the PCSV in operation, this means that a large amount of evaporation gas has been collected already in the canister, therefore, when the amount of fuel injection is smaller than the usual amount of fuel injection, with the engine and the PCSV in operation, it is determined that a dense gas flows into the engine by the operation of the PCSV and the heater needs to be operated.

Meanwhile, a large amount of evaporation gas is produced from the fuel in the fuel tank when the temperature of the fuel tank is high, in which it is determined that the heater of the canister needs to be operated.

When the temperature of the fuel tank is above a predetermined temperature, C° C., the determination may be made in response to a signal from a temperature sensor of the fuel tank or by estimating the temperature of the fuel tank on the basis of a signal from an external temperature sensor in the vehicle.

Further, when a difference in temperature is large, for example, a temperature difference $\Delta T$ per unit time is, for example, above D° C., even if the temperature of the air outside the vehicle is not high, the amount of evaporation in the fuel tank increases, such that it is also determined in this case that the heater of the canister needs to be operated.

The A, B, C, and D may be appropriately determined, depending on the vehicle, by tests and analysis.

In the operating a heater (S200), only the time when both the PCSV and the heater operate is accumulated and the heater is operated until the accumulated time reaches a reference time that is determined in advance such that the evaporation gas is sufficiently separated from the canister.

That is, in the operating a heater (S200) of various embodiments, count increases only when the heater operates and it is ascertained that the engine is in operation and the PCSV is in operation through the loop, and the loop continues until the count reaches a predetermined value, for example, Z or more in FIG. 1, while the heater is stopped and the count is initialized when the count is above the predetermined value.

Therefore, when the engine does not operate or the PCSV stops while the operating a heater (S200) has been started and the count increases, the process comes out of the loop, but the control enters again the operating a heat (S200), with the count memorized, the loop continues and the count is accumulated to reach the predetermined value such that the heater is prevented from stopping right after starting and the heater can operate only for the period where the efficiency is the highest.

That is, by determining the predetermined value to represent the time within a range where separation efficiency of the evaporation gas from the canister is the highest by heating of the heater, when it is determined that the heater of the canister should operate and the operating a heater (S200) starts, the count is accumulated for the predetermined time and the heater is operated, thereby the evaporation gas is effectively separated.

The predetermined value is the time taken to perform once the loop, it may be possible to separately determine the time range where the separation efficiency of an evaporation gas in the canister due to heating of the heater is the highest, and the time range where the separation efficiency of an evaporation gas in the canister due to heating of the heater may be appropriately determined by tests and analysis.

Meanwhile, when a plug-in hybrid vehicle is charged and travels a predetermined distance everyday, the engine may not operate for a long time. In this case, it may be required to operate the engine in order to protect the parts of the engine and prevent the lubricant from deteriorating. Accordingly, the present invention makes it possible to rapidly purge an evaporation gas with the start of the engine by preheating the heater of the canister by operating it in advance.

That is, the present invention further includes determining protecting an engine (S300) that determines whether it is required to operate the engine in order to protect the engine, regardless of SOC (State Of Charge) of the battery, and preparing protecting an engine (S301) that requests PCSV purging and connects the control to the operating a heater (S200), when the engine needs to be operated, as the result of performing the determining protecting an engine (S300) such that the evaporation gas can be quickly purged when the engine is operated while the heater is operated in advance by the operating a heater (S200).

For reference, a process (S10) for checking the operation of the engine and a process (S20) for checking that the PCSV is in operation, between the determining operating a heater (S100) and the operating a heater (S200) of FIG. 1, are provided to check the operational state of the engine and the PCSV and allows the control to enter the determining protecting an engine (S300), before entering the loop of the operating a heater (S200). Further, the purge request-ON signal in the flowchart is a signal to request purge through the PCSV to the engine and substantial purging is made by a specific logic by the conditions of the engine, even if the signal is turned off, such that purging of the engine can be achieved, regardless of the control of the heater.

For convenience in explanation and accurate definition in the appended claims, the terms outside and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An evaporation gas treating apparatus control method in a vehicle, the method comprising:

determining operation of a heater that determines whether to operate a heater of a canister due to a large amount of absorption of the canister;

determining protecting an engine that determines whether it is required to operate the engine in order to protect the engine, regardless of state of charge (SOC); and preparing protecting an engine that requests purge control solenoid valve (PCSV) purging and connects control to operating a heater when the engine needs to be operated; and operating a heater that operates the heater such that evaporation gases in the canister can be sufficiently separated, when it is required to operate the heater after the determining operating a heater.

2. The method as defined in claim 1, wherein the determining operation of a heater determines that the heater needs to be operated, in at least one case of when fuel has been supplied, when the vehicle is left for a long time, when a dense evaporation gas flows into an engine, with a purge control solenoid valve (PCSV) in operation, when the temperature of a fuel tank is above a predetermined temperature, and when a difference in temperature is large.

3. The method as defined in claim 2, wherein when the difference between the current amount of fuel and the previous amount of fuel is above a predetermined amount, it is determined that the fuel has been supplied, when the difference between the current time and the time of the last purging is above a predetermined time, it is determined that the vehicle has been left for a long period of time, and when the amount of fuel injection is smaller than the usual amount of fuel injection, with the engine and the PCSV in operation, it is determined that a dense gas flows into the engine by the operation of the PCSV.

4. The method as defined in claim 2, wherein the temperature of the fuel tank is estimated on the basis of a signal from an external temperature in the vehicle.

5. The method as defined in claim 2, wherein in the operating a heater, only the time when both the PCSV and the heater operate is accumulated and the heater is operated until the accumulated time reaches a reference time that is determined in advance such that the evaporation gas is sufficiently separated from the canister.

6. The method as defined in claim 5, wherein in the operating a heater, count increases only when the heater operates and it is ascertained that the engine is in operation and the PCSV is in operation through a loop, and the loop continues until the count reaches a predetermined value, while the heater is stopped and the count is initialized when the count is above the predetermined value.

* * * * *